US005684446A

United States Patent [19]

Adkins et al.

[11] Patent Number: 5,684,446

[45] Date of Patent: Nov. 4, 1997

[54] TRANSFORMER CORE-COIL FRAME ATTACHMENT AND GROUND

[75] Inventors: Herbert S. Adkins, Vienna, Mo.; Dennis J. Struemph, Jackson, Tenn.; Dean I. Parker, Russellville; Thomas A. Ward, Holts Summit, both of Mo.

[73] Assignee: ABB Power T&D Company Inc., Raleigh, N.C.

[21] Appl. No.: 730,624

[22] Filed: Oct. 21, 1996

[51] Int. Cl.[6] ..... H01F 27/02; H01F 27/26; H01F 27/30

[52] U.S. Cl. ..... 336/92; 336/196; 336/210

[58] Field of Search ..... 336/90, 92, 210, 336/196, 197, 65, 67, 68

[56] References Cited

U.S. PATENT DOCUMENTS

| | | | |
|---|---|---|---|
| 2,494,350 | 1/1950 | Mittermaier | 175/356 |
| 2,897,463 | 7/1959 | Denham | 336/65 |
| 3,011,139 | 11/1961 | Dierstein | 336/98 |
| 3,036,246 | 5/1962 | Valleau | 317/158 |
| 3,050,703 | 8/1962 | Duescher | 336/67 |
| 3,504,319 | 3/1970 | Leonard | 336/92 |
| 3,662,308 | 5/1972 | Muschong | 336/210 |
| 4,438,421 | 3/1984 | Leach, Jr. | 336/65 |
| 4,464,644 | 8/1984 | Fukatsu | 336/92 |
| 4,467,399 | 8/1984 | Van Husen | 336/92 |
| 4,533,786 | 8/1985 | Borgmeyer et al. | 174/50 |
| 4,631,509 | 12/1986 | Arii et al. | 336/92 |
| 4,754,250 | 6/1988 | Duin | 336/65 |
| 4,839,622 | 6/1989 | Hay | 336/92 |
| 4,890,086 | 12/1989 | Hill | 336/210 |
| 5,194,841 | 3/1993 | Galloway et al. | 336/92 |
| 5,319,341 | 6/1994 | Bisbee et al. | 336/67 |
| 5,337,034 | 8/1994 | Grimes | 336/92 |
| 5,402,321 | 3/1995 | Izu et al. | 361/807 |
| 5,469,124 | 11/1995 | O'Donnell et al. | 336/61 |

*Primary Examiner*—Thomas J. Kozma

*Attorney, Agent, or Firm*—Woodcock Washburn Kurtz Mackiewicz & Norris LLP

[57] ABSTRACT

A transformer core-coil frame attachment and ground. The core-coil is mounted on a metal frame with flanges extending along the bottom of the frame. Nonconductive support members in the form of channels are mounted on the flanges of the cross member to support the coil to relieve stresses and reduce the no-load electrical losses. The nonconductive support members have a profile shaped for ease in receiving and retaining the support members on the flanges of the cross member. The frame has an opening in the bottom for receiving a mounting boss protruding above the tank bottom of the transformer to locate the core-coil within the tank and resist movement of the core-coil within the tank in a horizontal plane. A compressible grounding structure is attached to the bottom of the core which allows for variation between the core and frame. Bracket structure is connected to the top of the frame and to brace structure secured to one of the sidewalls within the tank to limit movement of the core-coil in the vertical plane. This one point attachment keeps the unit from shifting during shipment.

20 Claims, 4 Drawing Sheets

TRANSFORMER CORE-COIL FRAME ATTACHMENT AND GROUND

BACKGROUND OF THE INVENTION

1. Field of the Invention

This invention relates to a core-coil assembly and mounting structure for a transformer of the type using a wound magnetic core, and more specifically to a novel arrangement for the suspension, grounding and attachment of the transformer core-coil within a transformer tank.

2. Description of the Prior Art

It is well known in the art to provide a transformer core and coil mounting in which two generally rectangular core loops are disposed side-by-side and having a coil surrounding thereto adjacent legs held in a U-frame for mounting the unit in a transformer tank. Examples of such transformer core and coil mounting frame assemblies are shown in U.S. Pat. Nos. 3,662,308 and 4,890,086. Another example of a prior art core-coil assembly utilizing a U-frame is disclosed in U.S. Pat. No. 5,194,841. In that patent there is disclosed a support for a wound magnetic core and its coil in such a way as to reduce mechanical stress on both core and coil and to reduce the core loss of the wound core. The core and coil are mounted within a U-frame support consisting of a steel frame member having inwardly bent flanges extending along its full length. Two pressure plates are fixed within and to the bottom flanges and have a height suitable to engage the bottom of the coil and to hold it at a height at which the bottom of the coil is pressed upwardly thus at least partially removing the weight of the coil from the bottom of the core members. The pressure plates were made of wood fiber. A cradle or sling of banding strap material supports the wound magnetic core from an upper fixed support to at least partially relieve the weight of the core on the transformer winding. The banding straps run over the top of the core, over the outside surface of the frame and under the core to apply an upward lifting force thereto. The bands are spaced from and did not press down on the top of the core. As shown in U.S. Pat. Nos. 3,662,308 and 4,890,086, the metal U-frames were bolted in two or more locations to the tank walls of the transformer to keep the core-coil from shifting during shipping. While these prior art arrangements were successful, they left something to be desired.

It would be desirable to provide a core-coil assembly for a transformer utilizing mounting structure including a frame and novel non-conductive support members shaped to be easily mounted and retained on the frame for suspending the core-coil to relieve stresses and reduce the no-load electrical losses. It would be desirable to have a core-coil frame attachment such that one point attachment will keep the unit from shifting during shipment. It would be desirable to utilize a mounting boss for locating the core-coil in the transformer tank and a bolt-in bracket for limiting the travel of the core-coil in the vertical plane thus keeping the core-coil down on the mounting boss to assist in limiting movement in the other two planes. Limiting the shifting of the core-coil assembly is important to keep the transformer leads from breaking during shipment. In the prior art, core grounding has been accomplished either by having dimples in the frame or by attaching metal strips from the cores to the frame using spot welds. Dimples do not work on a suspended design because the cores are not in contact with the frame. The use of metal straps is not desirable because the operation must be done after the assembly is put together and would have to be undone if the unit was disassembled. Thus it would be desirable to have compressible grounding structure secured to the core bottom which comes in contact with the metal frame. This allows for variation in the assembly and ease in disassembly.

SUMMARY OF THE INVENTION

The present invention is a new and improved core-coil assembly for a transformer including a magnetic core and coil and mounting structure for the core and coil. The mounting structure includes a U-shaped metal frame encompassing the core and coil and having a cross member from whose ends legs extend. The cross member and legs of the U-shaped frame comprise channels, each channel including flanges joined by a web. Non-conductive support members are mounted on the flanges of the cross member to support the coil. A top frame structure extends over the core and connects the legs for maintaining the core and coil within the U-shaped frame with the coil supported on the non-conductive support members. The non-conductive support members are channel-shaped and have a profile including an upper portion and a lower portion. The lower portion has an inverted substantially U-shaped cross section with spaced legs shaped for receiving and retaining between the spaced legs of the support members, the flanges of the cross member. The upper portion of the profile has a height for engaging the bottom of the coil and supporting the coil with respect to the core, thereby to reduce internal stress in the core due to the weight of the coil. The channel-shaped non-conductive support members have a length corresponding to the length of the flanges on the cross member. The spaced legs of the channel-shaped support members have at least one of their outer ends shaped for ease of installation of the support members of the flanges on the cross member.

The core-coil assembly is adapted for installation in a tank having a bottom and side walls for receiving therein the core-coil assembly. The tank bottom is provided with a mounting boss protruding above the tank bottom. The cross-member of the U-shaped frame has an opening therein for receiving the mounting boss on the tank bottom to locate the core-coil assembly within the tank and to resist movement of the core-coil assembly within the tank in a horizontal plane. Brace structure is secured to one of the sidewalls within the tank adjacent one of the legs of the U-shaped frame and bracket structure is connected to the top frame structure and to the brace structure to limit movement of the core-coil assembly in the vertical plane. The core of the core-coil assembly has secured to the bottom thereof compressible grounding structure which is shaped to contact the cross member of the U-shaped metal frame to provide a ground connection therewith. In one form of the invention the compressible grounding structure comprises at least one metal loop structure welded to the bottom of the core, the loop structure being shaped to contact the cross member of the U-shaped metal frame to provide a ground connection therewith.

BRIEF DESCRIPTION OF THE DRAWINGS

For a more detailed disclosure of the invention and for further objects and advantages thereof, reference is to be had to the following description taken in conjunction with the accompanying drawings.

DESCRIPTION OF THE PREFERRED EMBODIMENT

Figure 1:
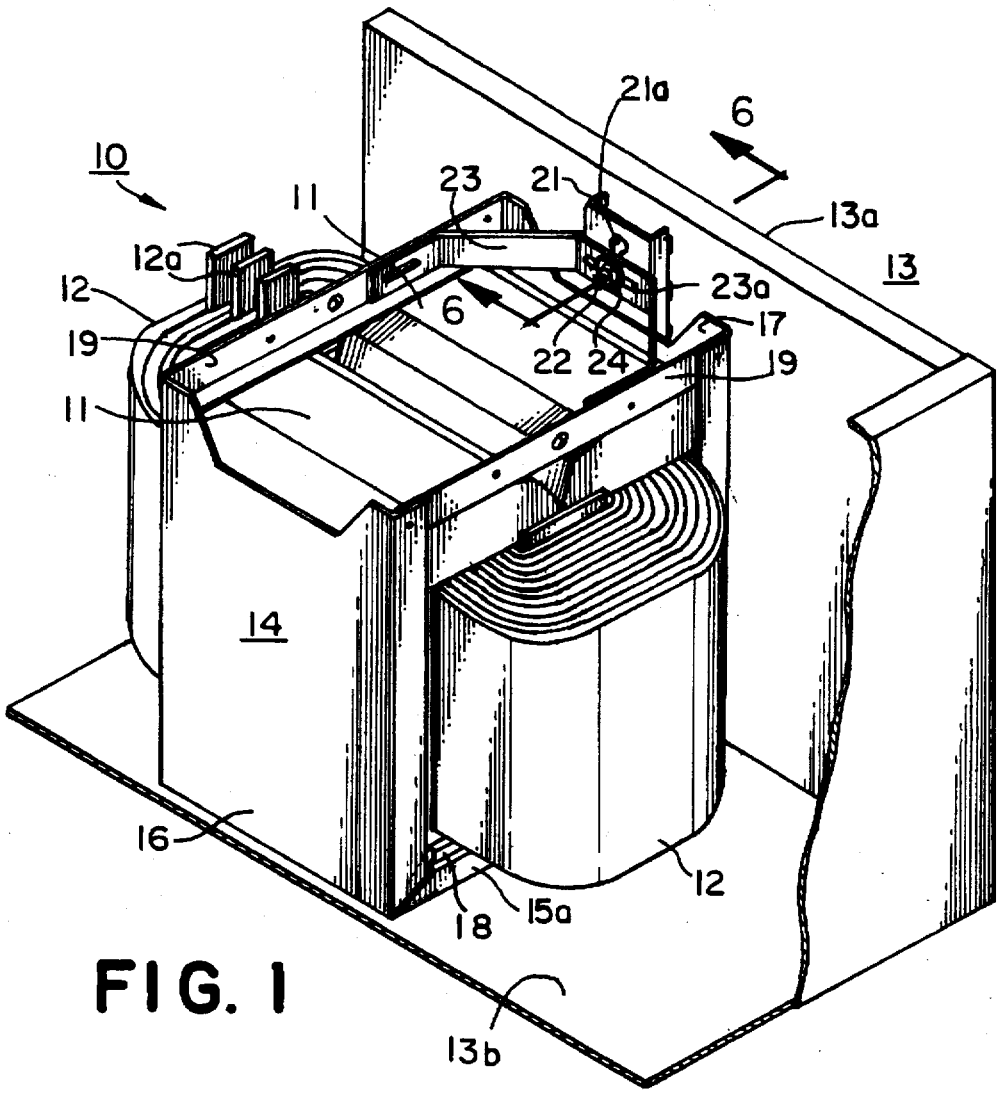
FIG. 1 is a perspective view of the core-coil assembly and mounting structure for a transformer embodying the present invention with portions of the structure broken away for clarity.

In accordance with the present invention there is illustrated in FIG. 1 a transformer core-coil assembly 10 including a magnetic core 11 and coil 12 and mounting structure for mounting the core and coil within a transformer tank 13. In FIG. 1 the transformer tank 13 has been partially broken away for purposes of clarity. The transformer tank is normally an enclosed metal tank having a bottom, top and a plurality of vertically extending walls to form an enclosure around the core-coil assembly which is disposed within the tank and immersed in a suitable liquid dielectric such as mineral oil. The transformer tank 13 includes a wall **13*a* having a front surface, not shown, on which electrical terminals are mounted, such as high voltage bushings and low voltage bushings. The core-coil assembly 10 comprises two substantially rectangular wound magnetic core loops 11 disposed side-by-side with adjacent vertical legs of the two adjacent core loops constituting a pair of inner legs and a pre- formed coil 12 surrounding these inner legs. The coil 12 has terminals 12*a***. This is conventional core-coil construction.

Figure 5:
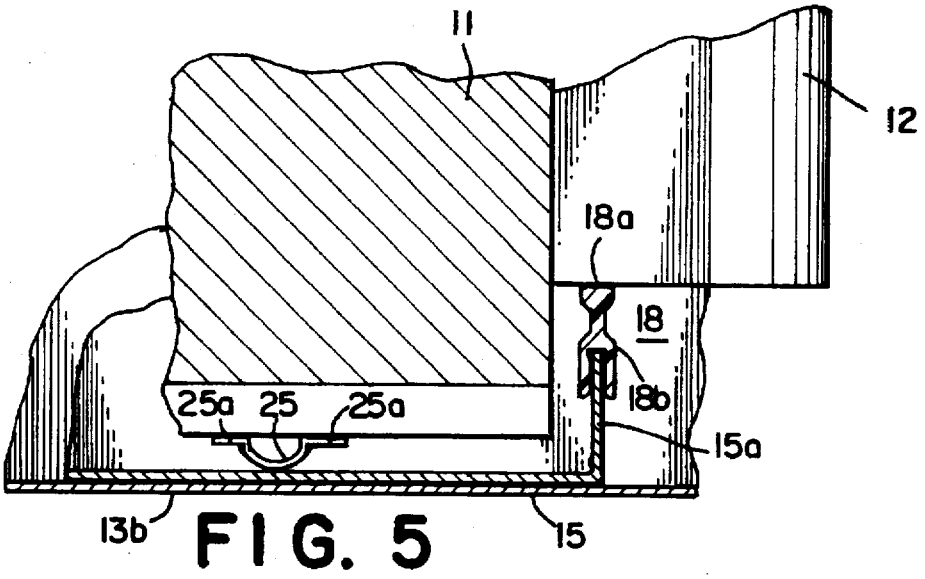
FIG. 5 is a sectional view taken along the lines 5—5 in FIG. 4.
Figure 7A:
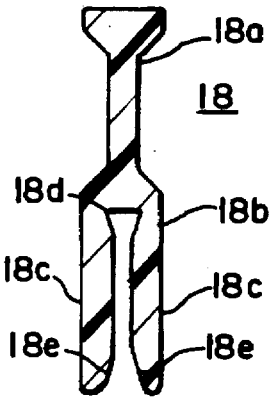
FIGS. 7A–7E are cross sectional views showing various profile modifications for the channel-shaped nonconductive support members shown in FIG. 1.
Figure 7B:
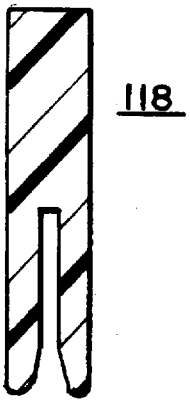
Figure 7C:
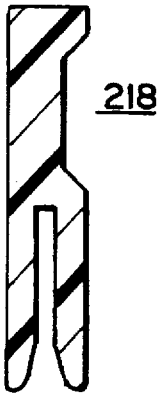
Figure 7D:
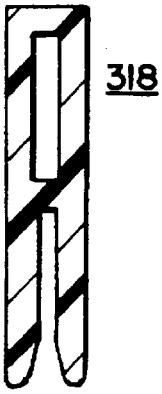
Figure 7E:
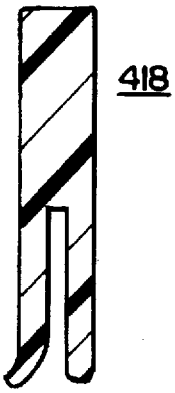

The core-coil assembly 10 is disposed within mounting structure including a U-shaped metal frame 14 encompassing the core 11 and coil 12. The U-shaped metal frame 14 includes a cross member 15 from whose ends legs 16 and 17 extend. As may be seen in FIG. 2 the cross-member 15 and legs 16, 17 each comprise channels with each channel including respectively flanges **15*a*, 16*a* and 17*a* joined by a web. The core-coil assembly 10 has been removed from FIG. 2 for clarity. Mounted on the flanges 15*a* of the cross member 15 are nonconductive support members 18 which are adapted to support the coil 12. As best seen in FIGS. 5 and 7A the nonconductive support members 18 have a profile including an upper portion 18*a* and a lower portion 18*b*. The lower portion 18*b* has an inverted substantially U-shaped cross section with spaced legs 18*c* shaped for receiving and retaining between the spaced legs of the support members, the flanges 15*a* of the cross member 15, FIG. 5. The upper portion 18*a* of the profile has a height for engaging the bottom of the coil 12 and supporting the coil 12 with respect to the core 11, thereby to reduce internal stress in the core due to the weight of the coil. The channel-shaped nonconductive support members 18 have a length substantially corresponding to the length of the flanges 15*a* on the cross member 15, FIG. 2. The support members 18** are made from a nonconductive insulating material which is flame resistant and has adequate strength to support the coil. A suitable material is a composite material including resin and glass fibers and capable of being extruded into varying lengths having the selected profile.

Figure 3:
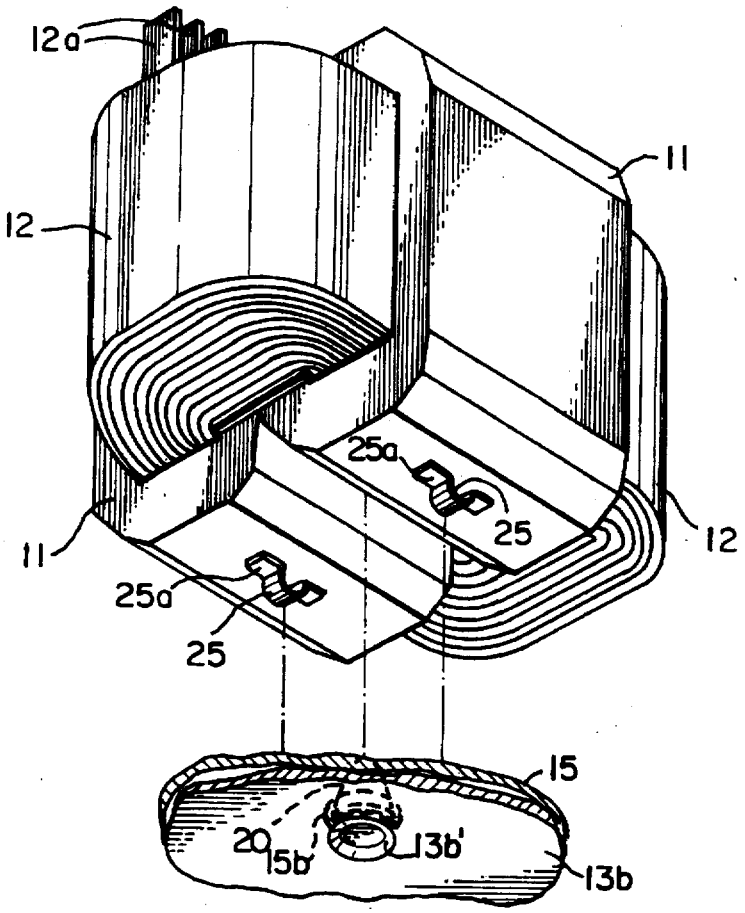
FIG. 3 is an exploded perspective view showing the bottom of the core-coil assembly of FIG. 1 with the grounding structure.
Figure 4:
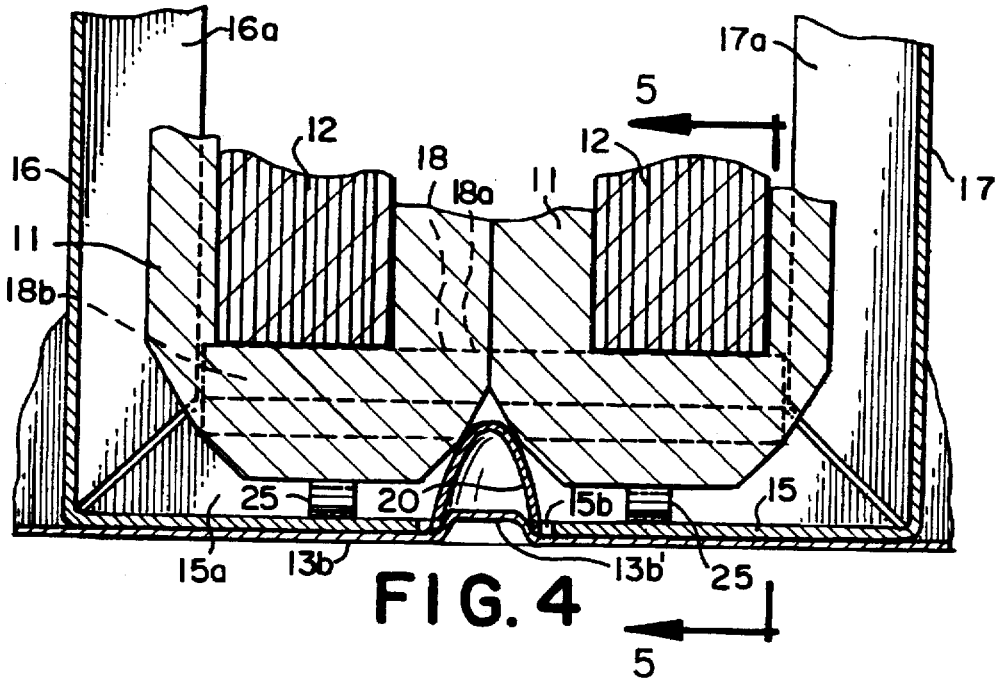
FIG. 4 is a sectional view through the core-core assembly of FIG. 1 showing the grounding structure and locating structure of FIG. 3.

A top frame structure comprising a pair of top frames 19 engage and extend over the core 11 and connect the legs 16 and 17 of the U-frame 14, FIG. 1. The top frames 19 hold the core-coil assembly 10 within the U-frame 14 with the coil 12 supported on the nonconductive support members 18. As pointed out above and as shown in FIG. 1, the transformer tank 13 is provided with a bottom and sidewalls for receiving therein the core-coil assembly 10. The tank bottom **13*b* has secured thereto a mounting boss 20 which protrudes above the surface of the tank bottom 13*b*. As best seen in FIGS. 3 and 4 the bottom wall 13*b* of the tank 13 is provided with an indentation 13*b*' to which the mounting boss 20 is welded. The cross member 15 of the U-shaped frame 14 is provided with a central opening 15*b* therein, FIGS. 2–4, for receiving the mounting boss 20 on the tank bottom 13*b* to locate the core-coil assembly 10 within the tank 13 and to resist movement of the core-coil assembly 10** within the tank in a horizontal plane.

Figure 6:
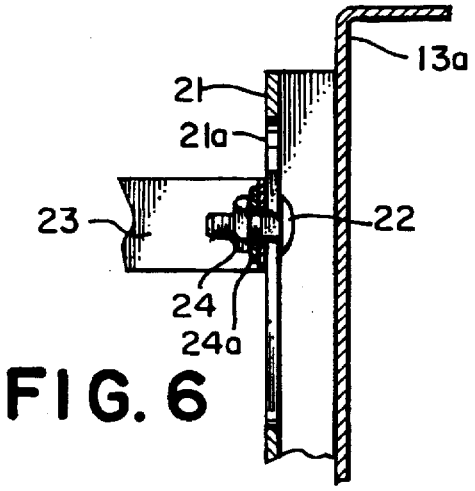
FIG. 6 is a sectional view taken along the lines 6—6 in FIG. 1.
Figure 2:
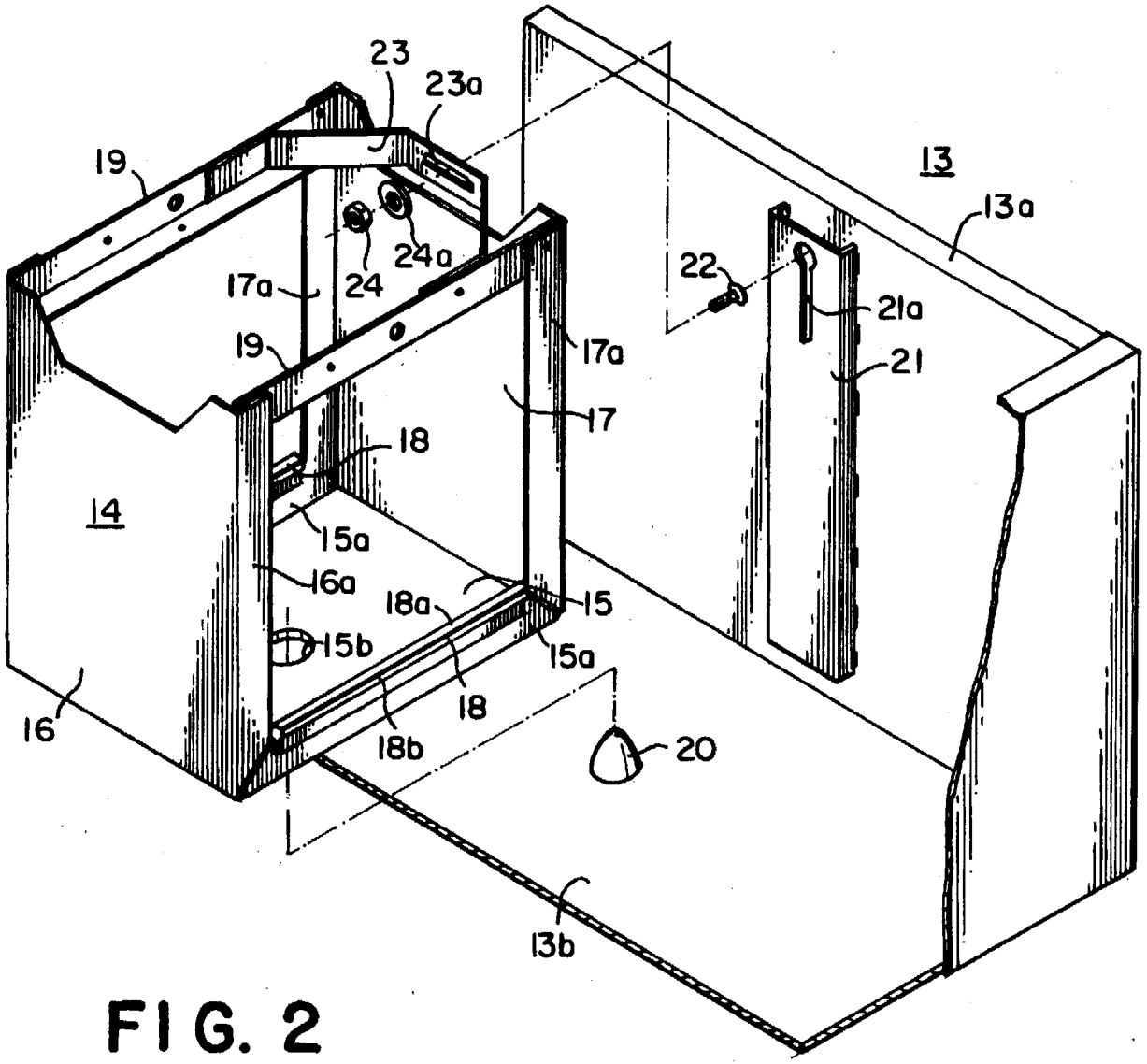
FIG. 2 is an exploded view of the mounting structure illustrated in FIG. 1 with the core-coil assembly removed for clarity.

A slotted brace 21 in the form of a channel having a vertical slot **21*a* therein, FIGS. 1, 2 and 6, is welded to the back surface of the front wall 13*a* of the tank 13. The slot 21*a* is adapted to receive the head of a carriage bolt 22, FIGS. 2 and 6, which is free to slide vertically within the slot 21*a*. A U-shaped bracket 23 has the ends thereof secured to the two top frame members 19, FIGS. 1 and 2. The central portion of the bracket 23 is provided with a longitudinal slot 23*a* which is adapted to receive the threaded end of the bolt 22. A nut 24 and washer 24*a* are adapted to be received on the threaded end of the bolt 22 to lock the bracket 23 to the brace 21. As shown in FIG. 1 this locks the frame structure 14 to the brace 21 and thus limits movement of the core-coil assembly 10** in the vertical plan.

As shown in FIGS. 3–5 the core structure 11 has secured to the bottom thereof compressible grounding structure shaped to contact the cross member 15 of the U-shaped metal frame and provide a ground connection therewith. The compressible grounding structure has been illustrated in the form of metal loop structure 25 welded at **25*a* to the bottom of the core structure 11. The loop structures 25 are made from a resilient metal such as core steel, which will provide a compressible or spring action when it engages the bottom 15 of the U-frame 14. This allows for variation in the assembly of the core-coil 10 within the frame 14**.

The nonconductive support members 18 for supporting the coil 12 may have various profiles. The preferred profile is illustrated in FIG. 7A. The upper portion **18*a* of the profile is similar in shape to an I-beam. The lower portion 18*b* of the profile has an inverted substantially U-shaped cross section with spaced legs 18*c* shaped for receiving and retaining therebetween the flanges 15*c* of the cross member 15, FIG. 5. The spacing between the legs 18*c* is selected so as to provide a snug fit when the flange 15*a* is inserted therebetween. With a snug fit on the flange 15*a* there is no wobble of the support member 18 on the flanges 15*a*. To aid in the "gripping" action on the flanges 15*a* the spacing 18*d* between the upper ends of the legs 18*c* may be slightly greater than the spacing between the central portions of the legs. This provides for a gripping action similar to a wooden clothes pin. It will be noted that the outer ends 18*e* of the legs are shaped for ease of installation of the support members 18 on the flanges 15*a* of the cross member 14. This shape may take the form of a chamfer or progressive curve as illustrated in FIG. 7A. Other profiles 118, 218, 318 and 418 for the channel-shaped nonconductive support members 18** are shown in FIGS. 7B–7E.

The function of the nonconductive support members 18, 118, 218, 318, 418 is to serve as a support and electrical insulation. The material from which the support members are constructed should have a strength adequate to support approximately 40 lbs. per linear inch. An example of a suitable material for the nonconductive support members is a composite material molded from a nonconductive fiberglass reinforced resin. The nonconductive support members of the present invention have the advantage that they are easy to install on the frame and do not require additional attaching members. The construction with the spaced legs retains the support members on the flanges of the frame and avoids slipping out of position after the core-coil assembly has been installed in the frame. By extruding the support members, a low cost per part can be achieved.

The core-coil frame attachment of the present invention has numerous advantages. It utilizes a single attachment point to keep the core-coil unit 10 from shifting during shipment. The mounting boss 20 on the bottom of the transformer tank locates the coil-coil assembly 10 in the transformer tank. The bolt-in bracket limits the travel of the core-coil assembly 10 in the vertical plane and keeps the core-coil assembly down on the mounting boss 20 which assists in limiting movement in the other two planes. Limiting the travel of the core-coil assembly is important to keep the leads from breaking.

While there has been described and illustrated a preferred embodiment of the invention, it will be understood that further modifications may be made without departing from the spirit and scope of the invention as set forth in the appended claims.

What is claimed is:

1. A core-coil assembly for a transformer including a magnetic core and coil and mounting structure for mounting said core and coil within a transformer tank, said mounting structure comprising a U-shaped metal frame encompassing said core and coil and having a cross member from whose ends legs extend, said cross member and legs of said U-shaped frame comprising channels, each channel including flanges joined by a web, and nonconductive support members mounted on said flanges of said cross member to support said coil, top frame structure extending over said core and connecting said legs of said U-shaped frame for maintaining said core and coil within said U-shaped frame with said coil supported on said nonconductive support members, a tank having a bottom and side walls for receiving therein the core-coil assembly, said tank bottom having a mounting boss protruding above said tank bottom, said cross-member of said U-shaped frame having an opening therein for receiving the mounting boss on said tank bottom to locate said core-coil assembly within said tank and to resist movement of said core-coil assembly within said tank in a horizontal plane, brace structure secured to one of said sidewalls within said tank adjacent one of said legs of said U-shaped frame, and bracket structure connected to said top frame structure and to said brace structure to limit movement of the core-coil assembly in the vertical plane.

2. A core-coil assembly for a transformer according to claim 1 wherein said nonconductive support members are channel-shaped, said support members having a profile including an upper portion and a lower portion, said lower portion having an inverted substantially U-shaped cross section with spaced legs shaped for receiving and retaining between said spaced legs of the support members, the flanges of said cross member, and said upper portion of said profile having a height for engaging the bottom of said coil and supporting said coil with respect to said core, thereby to reduce internal stress in said core due to the weight of said coil.

3. A core-coil assembly for a transformer according to claim 2 wherein said channel-shaped nonconductive support members have a length corresponding to the length of the flanges on said cross member.

4. A core-coil assembly for a transformer according to claim 3 wherein the spaced legs of said channel-shaped support members have at least one of their outer ends shaped for ease of installation of said support members on said flanges of said cross member.

5. A core-coil assembly for a transformer according to claim 3 wherein the spaced legs of said channel-shaped support members have at least one of their outer ends chamfered.

6. A core-coil assembly for a transformer according to claim 5 wherein both of the outer ends of said spaced legs on said channel-shaped support members are chamfered.

7. A core-coil assembly for a transformer according to claim 1 wherein said core has compressible grounding structure secured to the bottom of said core, said compressible grounding structure being shaped to contact said cross member of said U-shaped metal frame to provide a ground connection therewith.

8. A core-coil assembly for a transformer according to claim 7 wherein said compressible grounding structure comprises at least one metal loop structure welded to the bottom of said core, said loop structure being shaped to contact said cross member of said U-shaped metal frame to provide a ground connection therewith.

9. A core-coil assembly for a transformer according to claim 8 wherein said core has two metal loop structures welded to the bottom of said core in spaced relation, both of said loop structures being shaped to contact said cross member of said U-shaped metal frame to provide a ground connection therewith. provide a ground connection therewith.

10. A core-coil assembly for a transformer including a magnetic core and coil and mounting structure for mounting said core and coil, said mounting structure comprising a U-shaped metal frame encompassing said core and coil and having a cross member from whose ends legs extend, said cross member and legs of said U-shaped frame comprising channels, each channel including flanges joined by a web, and channel-shaped nonconductive support members mounted on said flanges of said cross member to support said coil, said nonconductive support members having a profile including an upper portion and a lower portion, said lower portion having an inverted substantially U-shaped cross section with spaced legs shaped for receiving and retaining between said spaced legs of the support members the flanges of said cross member, and said upper portion of said profile having a height for engaging the bottom of said coil and supporting said coil with respect to said core, thereby to reduce internal stress in said core due to the weight of said coil.

11. A core-coil assembly for a transformer according to claim 10 including top flange structure extending over said core and connecting said legs of said U-shaped frame for maintaining said core and coil within said U-shaped frame with said coil supported on said nonconductive support members.

12. A core-core assembly for a transformer according to claim 10 wherein said channel-shaped nonconductive support members have a length corresponding to the length of the flanges on said cross member.

13. A core-coil assembly for a transformer according to claim 10 wherein the spaced legs of said channel-shaped support members have at least one of their outer ends shaped for ease of installation of said support members on said flanges of said cross member.

14. A core-coil assembly for a transformer according to claim 13 wherein the spaced legs of said channel-shaped support members have at least one of their outer ends chamfered.

15. A core-coil assembly for a transformer according to claim 13 wherein both of the outer ends of said spaced legs on said channel-shaped support members are chamfered.

16. A core-coil assembly for a transformer according to claim 11 wherein said core has compressible grounding structure secured to the bottom of said core, said compressible grounding structure being shaped to contact said cross member of said U-shaped metal frame to provide a ground connection therewith.

17. A core-coil assembly for a transformer according to claim 16 wherein said compressible grounding structure comprises at least one metal loop structure welded to the bottom of said core, said loop structure being shaped to contact said cross member of said U-shaped metal frame to provide a ground connection therewith.

18. A core-coil assembly for a transformer including a magnetic core and coil and mounting structure for said core and coil, said mounting structure comprising a U-shaped metal frame encompassing said core and coil and having a cross member from whose ends legs extend, said cross member and legs of said U-shaped frame comprising channels, each channel including flanges joined by a web, nonconductive support members mounted on said flanges of said cross member to support said coil, compressible grounding structure secured to the bottom of said core, said compressible grounding structure being shaped to contact said cross member of said U-shaped metal frame to provide a ground connection therewith, and top frame structure extending over said core and connecting said legs of said U-shaped frame for maintaining said core and coil within said U-shaped frame with said coil supported on said nonconductive support members and said compressible grounding structure in contact with said cross member of said U-shaped frame to provide a ground connection therewith.

19. A core-coil assembly for a transformer according to claim 18 wherein said compressible grounding structure comprises at least one metal loop structure welded to the bottom of said core, said loop structure being shaped to contact said cross member of said U-shaped metal frame to provide a ground connection therewith.

20. A core-coil assembly for a transformer according to claim 19 wherein said core has two metal loop structures welded to the bottom of said core in spaced relation, both of said loop structures being shaped to contact said cross member of said U-shaped metal frame to provide a ground connection therewith.

* * * * *